US007845273B2

(12) United States Patent
Dumenil et al.

(10) Patent No.: US 7,845,273 B2
(45) Date of Patent: Dec. 7, 2010

(54) TRANSFER DEVICE AND PRINTING PRESS

(75) Inventors: François Dumenil, Chaumes en Brie (FR); Maurice Billet, Chambourcy (FR)

(73) Assignee: Machines Dubuilt, Noisy-le-Grand (FR)

( * ) Notice: Subject to any disclaimer, the term of this patent is extended or adjusted under 35 U.S.C. 154(b) by 700 days.

(21) Appl. No.: 11/902,835

(22) Filed: Sep. 26, 2007

(65) Prior Publication Data

US 2008/0245244 A1 Oct. 9, 2008

(30) Foreign Application Priority Data

Sep. 26, 2006 (FR) ..... 06 08431

(51) Int. Cl.
*B41F 17/18* (2006.01)
*B41F 17/08* (2006.01)
*B65G 47/00* (2006.01)

(52) U.S. Cl. ..... 101/44; 101/35; 101/40; 414/783; 414/776

(58) Field of Classification Search ..... 101/35, 101/38.1, 39, 40, 40.1, 43, 44; 414/783, 414/774, 776
See application file for complete search history.

(56) References Cited

U.S. PATENT DOCUMENTS 5,333,720 A * 8/1994 Zwigart et al. ..... 198/409

FOREIGN PATENT DOCUMENTS

| | | |
|---|---|---|
| DE | 44 31 596 C1 | 10/1995 |
| EP | 0 535 981 A1 | 4/1993 |
| FR | 2 775 471 A | 9/1999 |

* cited by examiner

*Primary Examiner*—Leslie J Evanisko
(74) *Attorney, Agent, or Firm*—Young & Thompson

(57) ABSTRACT

A transfer device (26) intended to move an object (8) between a support zone (28) and a cap (12), includes: a frame (30); at least one holding arm (32) which is able to carry the object (8) to be moved; and drive elements (36) which are carried by the frame (30), and able to move the holding arm (32). The drive elements (36) are able to move the holding arm (32) so that the opening (19) of the object is moved firstly along an initial trajectory portion which includes a component in accordance with a direction perpendicular to the support zone (28), then along a curve which extends through a point (119) of the trajectory (118) of the base (17) of the object, after the base (17) of the object has passed through that point.

15 Claims, 10 Drawing Sheets

TRANSFER DEVICE AND PRINTING PRESS

TECHNICAL FIELD

The present invention relates to a transfer device of the type intended to move an object between a support zone and a cap, the object comprising a base and an opening, the cap comprising a bottom which extends in a plane perpendicular to the support zone and a peripheral rim having a shape complementary to the shape of the base of the object, the device comprising:

a frame;

at least one holding arm which is carried by the frame, the holding arm being able to carry the object to be moved; and drive means which are carried by the frame.

In particular, the invention relates to a transfer device which is intended to move objects having an elliptical or cylindrical cross-section in order to carry out printing thereof on a printing press comprising a rotating plate having a vertical axis of rotation.

BACKGROUND TO THE INVENTION

There is known a transfer device comprising a lifting arm which is provided with holding clips and which is mounted so as to pivot at one of the ends thereof about an axis of rotation which extends in a horizontal plane which is defined in the depositing plane of the object. The arm is capable of pivoting about the axis of rotation between a loading position, in which the arm extends in a vertical direction, and an unloading position, in which the arm extends in a horizontal direction.

However, this transfer device does not allow the object to be printed to be arranged in a device for retaining and rotating the object in order to print it, comprising a cap which comprises a vertical bottom and a rim having a shape complementary to the shape of the base of the object.

Since the device pivots the object through a right-angle about an axis belonging to the depositing plane of the object, the object cannot be introduced and positioned against the bottom of the cap so as to cooperate with the rim.

The problem addressed by the invention is to provide a transfer device allowing the object to be printed to be positioned in a device for retaining and rotating the object.

SUMMARY OF THE INVENTION

To that end, the invention relates to a transfer device of the above-mentioned type, characterised in that the drive means are able to move the holding arm so that the opening of the object is moved firstly along an initial trajectory portion which comprises a component, in a direction perpendicular to the support zone, which is orientated in the opposite direction to the support zone, then along a curve which extends through a point of the trajectory of the base of the object, after the base of the object has passed through that point.

According to specific embodiments, the transfer device comprises one or more of the features set out in the dependent claims.

The invention also relates to a printing press comprising:

a chassis;

a plate which rotates about a vertical axis of rotation and which is carried by the chassis;

at least one device for retaining and driving the object to be printed that is carried by the rotating plate, the retention and drive device comprising a cap; and at least one printing station which is carried by the chassis in alignment with the rotating plate;

characterised in that it further comprises a transfer device according to the invention which is able to take the object to be printed from a support zone and to position it inside the cap of the device for retaining and driving the object.

According to specific embodiments, the printing press comprises one or more of the features set out in the dependent claims.

BRIEF DESCRIPTION OF THE DRAWINGS

The invention will be better understood from a reading of the description below, given purely by way of example and with reference to the drawings, in which.

DESCRIPTION OF PREFERRED EMBODIMENTS

The printing press 2 according to the invention comprises a chassis which is not illustrated, a rotating plate 4 which is carried by the chassis, at least one device 6 for retaining and driving the objects which is carried by the rotating plate 4, and stations for processing the objects which are not illustrated and which are arranged around the rotating plate 4.

The rotating plate 4 is able to be rotated about a vertical axis of rotation by drive means 5 in order to move the objects to be printed from one processing station to another.

The drive means 5 comprise a global cam indexer which is driven via a step-down gear by an asynchronous motor or a servo motor.

Figure 1:
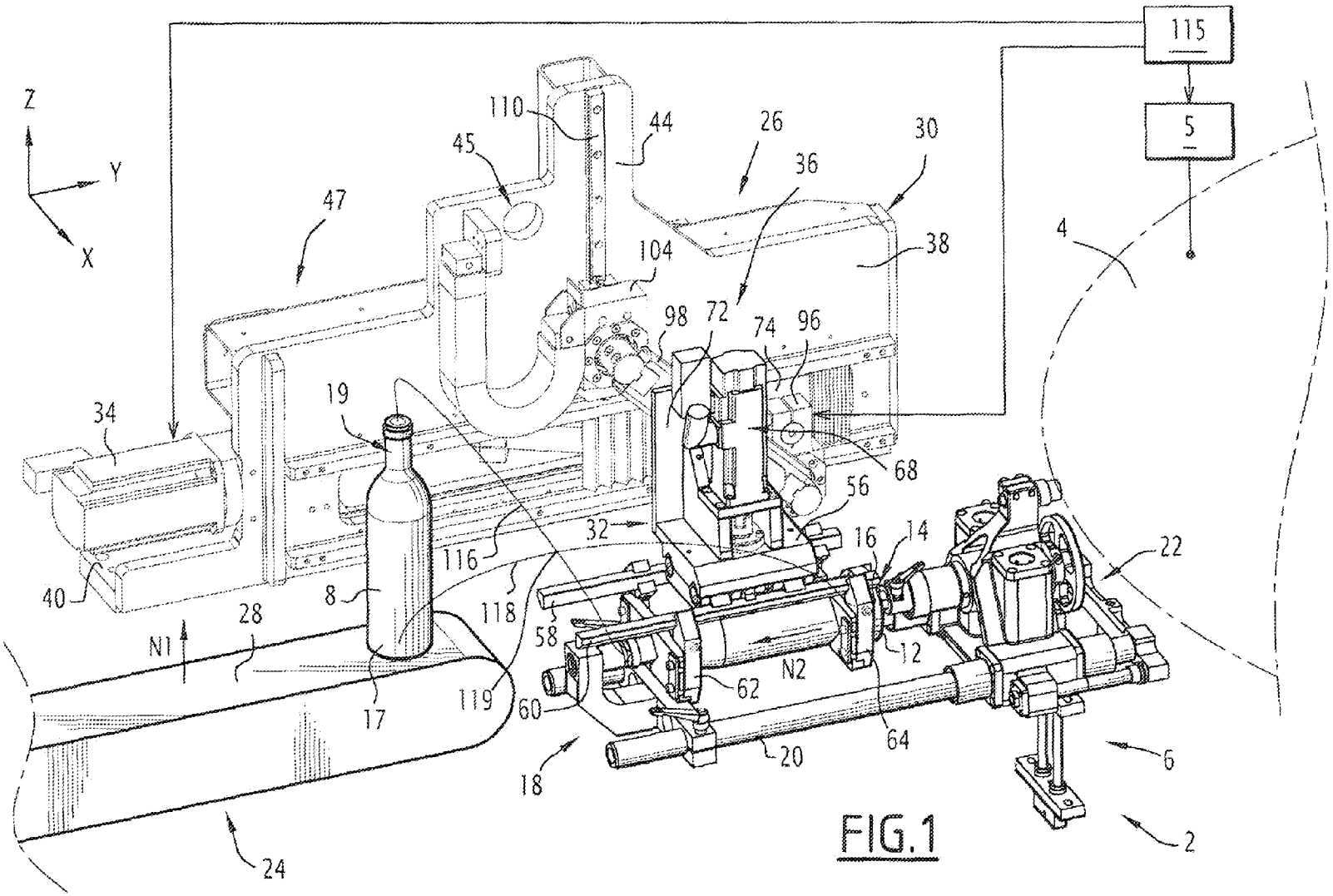
FIG. 1 is a perspective front view of a loading conveyor for an object to be printed and a printing press according to the invention.

The processing stations comprise, for example, a loading station, illustrated in FIG. 1, and, for example, a bleaching station, one or more stations for printing by means of serigraphy or marking in the hot state, a drying station, a varnishing station and an unloading station which is identical to the loading station.

The retention and drive assembly 6 comprises a cap 12 and an end-piece 18 for retaining the opening 19 of the object, which end-piece is arranged opposite the cap 12. In this instance, the objects 8 are bottles whose neck forms the opening 19.

The cap 12 is constituted by a vertical bottom 14 which is parallel with the plane defined by directions X and Z illustrated in FIG. 1 and a rim 16 which delimits an indentation having a shape complementary to the shape of the base 17 of the bottle 8.

The end-piece 18 can be moved in translation in the direction Y towards and away from the cap 12 in order to grip the bottle 8 axially between the cap 12 and the end-piece 18. To that end, the end-piece 18 is mounted so as to be movable in terms of translation along two runner supports 20. The cap 12 can be driven axially in rotation by drive means 22. Unlike the end-piece, the cap 12 is fixed in terms of translation in the direction Y.

On the retention and drive assembly 6, the objects 8 to be printed are arranged with their axis of revolution arranged horizontally in accordance with the normal N2 relative to the plane of the bottom of the cap.

The printing press 2 further comprises a charging conveyor 24 for the bottles 8 to be printed and a transfer device 26 which is carried by the chassis and which is adapted to move the bottles 8 from the charging conveyor 24 to the retention and drive assembly 6.

The printing press 2 further comprises a discharging conveyor for the printed objects (not illustrated) and a transfer device (not illustrated) which brings about the unloading of the printed objects 8 from the retention and drive assembly 6 to the discharging conveyor.

The charging conveyor 24 comprises a transport belt 28 which is closed in a loop and held between two parallel return cylinders, one of which is motor-driven. On that conveyor, the bottles 8 are successively arranged in alignment, with the axis of revolution thereof arranged in the vertical direction Z parallel with a normal N1 relative to the transport belt 28.

The transport belt 28 constitutes a support zone for the objects.

The transfer device 26 is able to take a bottle whose base 17 is supported on the support zone 28, transfer it towards the retention and drive device 6, pivoting it through an angle of 90° about an axis parallel with the direction X, and introduce its base 17 into the cap 12.

The transfer device 26 comprises a frame 30, a holding arm 32 which is carried by the frame 30 and a motor 34 for driving the drive means 36 of the holding arm 32 in terms of movement.

The frame 30 comprises a support plate 38 and a plate 40 which forms the base of the frame 30, the plate 40 being fixed to the support plate 38 by one of the longitudinal sides 41 thereof so that the main face of the plate 40 extends perpendicularly relative to the main face of the support plate 38.

The support plate 38 is generally of rectangular shape and has a vertical extension 44 which is arranged remote from the plate 40.

The support plate 38 separates a front edge 45 and a rear edge 47 of the transfer device 26.

In the remainder of the description, the orientations "front" and "rear" will be defined in relation to the support plate 38.

The frame 30 further comprises a beam 46 which extends in the direction Y and which is fixed at the edge of the rear face 47 of the support plate 38, and two cross-members 48 and 50 which are each fixed to an end of the beam 46 and to a side 42 of the plate 40 opposite those ends.

The frame 30 further comprises a hollow retention beam 54 which is fixed to the rear face 47 of the extension 44 and the beam 46. The retention beam 54 extends in the direction Z above the beam 46.

Figure 4:
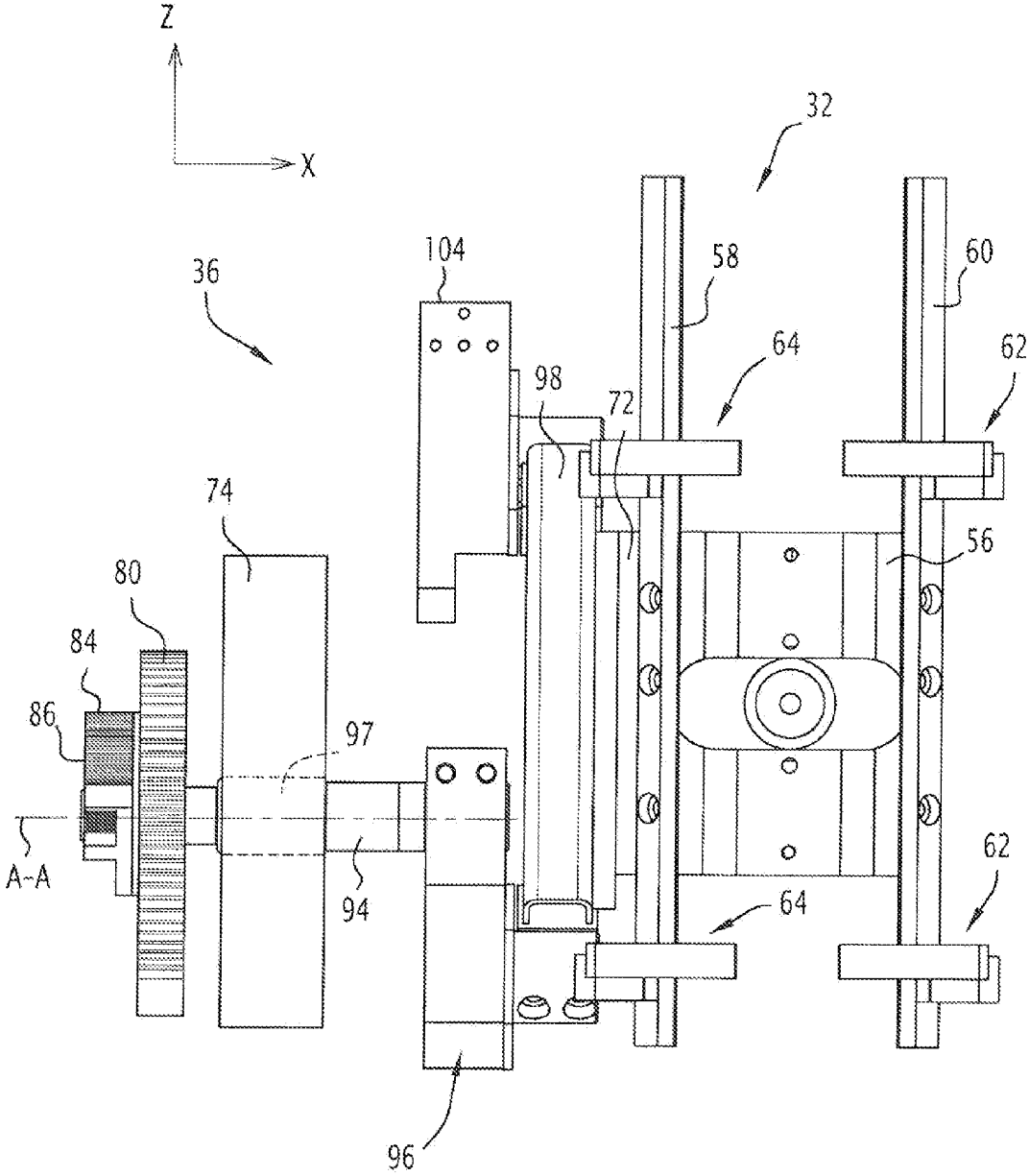
FIG. 4 is a side view of a portion of the drive means and the holding arm of the transfer device of FIGS. 2 and 3.
Figure 5:
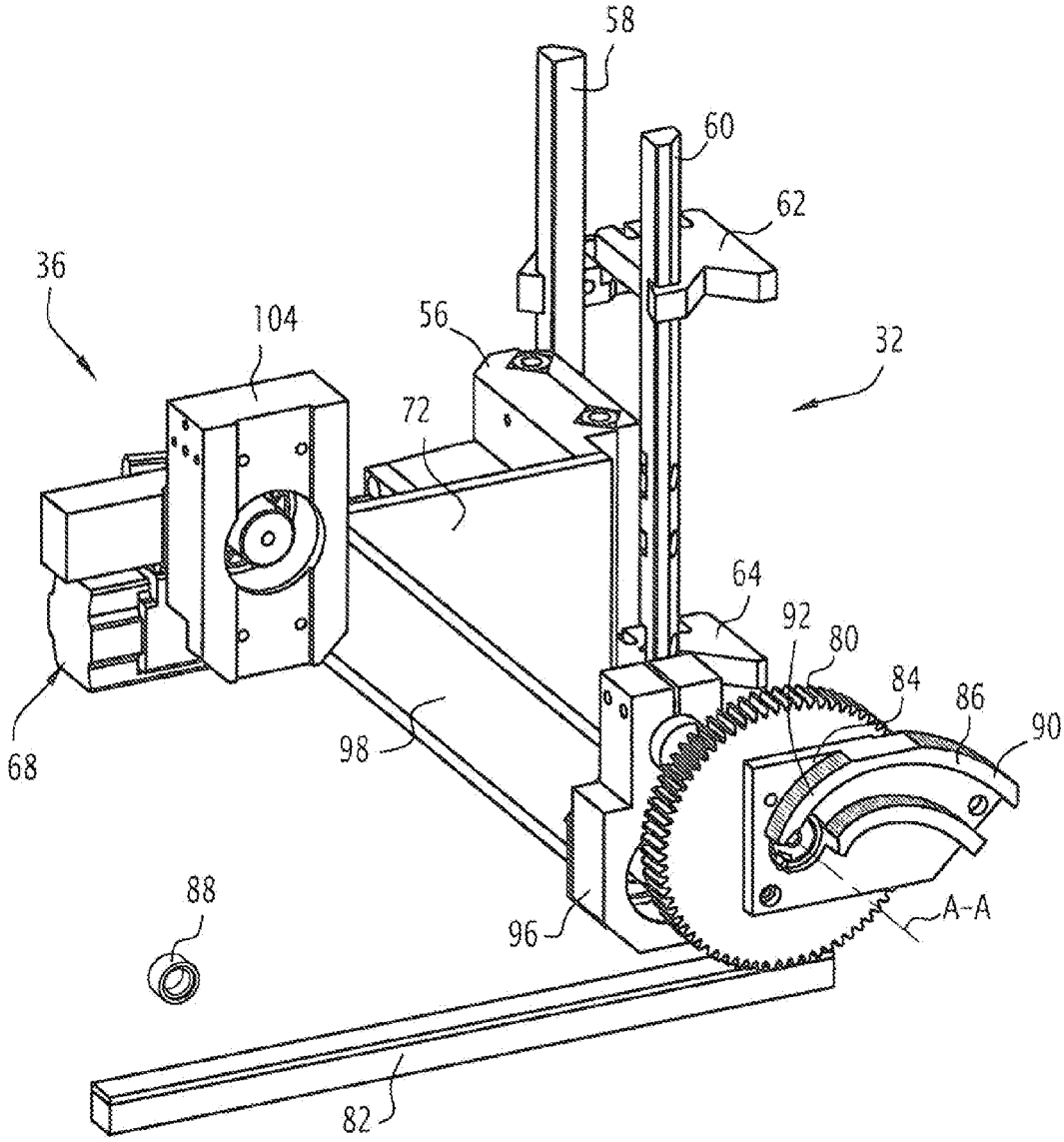
FIG. 5 is a perspective rear view of a portion of the drive means and the holding arm of the transfer device.

The holding arm 32, which is illustrated in FIGS. 4 and 5, comprises a bracket 56, two support bars 58, 60 which are fixed along the longitudinal edges of the bracket 56 and two pairs 62, 64 of holding clips which are mounted so as to slide along the support bars 58 and 60.

The bracket 56 is generally of parallelepipedal shape having a main face, to which the support bars 58 and 60 are fixed, and an opposing main face, on which a device 68 for actuating the pairs of clips is mounted.

The holding arm 32 further comprises a cross-member 72 of triangular shape, one side of which is fixed to the lateral side of the bracket 56.

Figure 2:
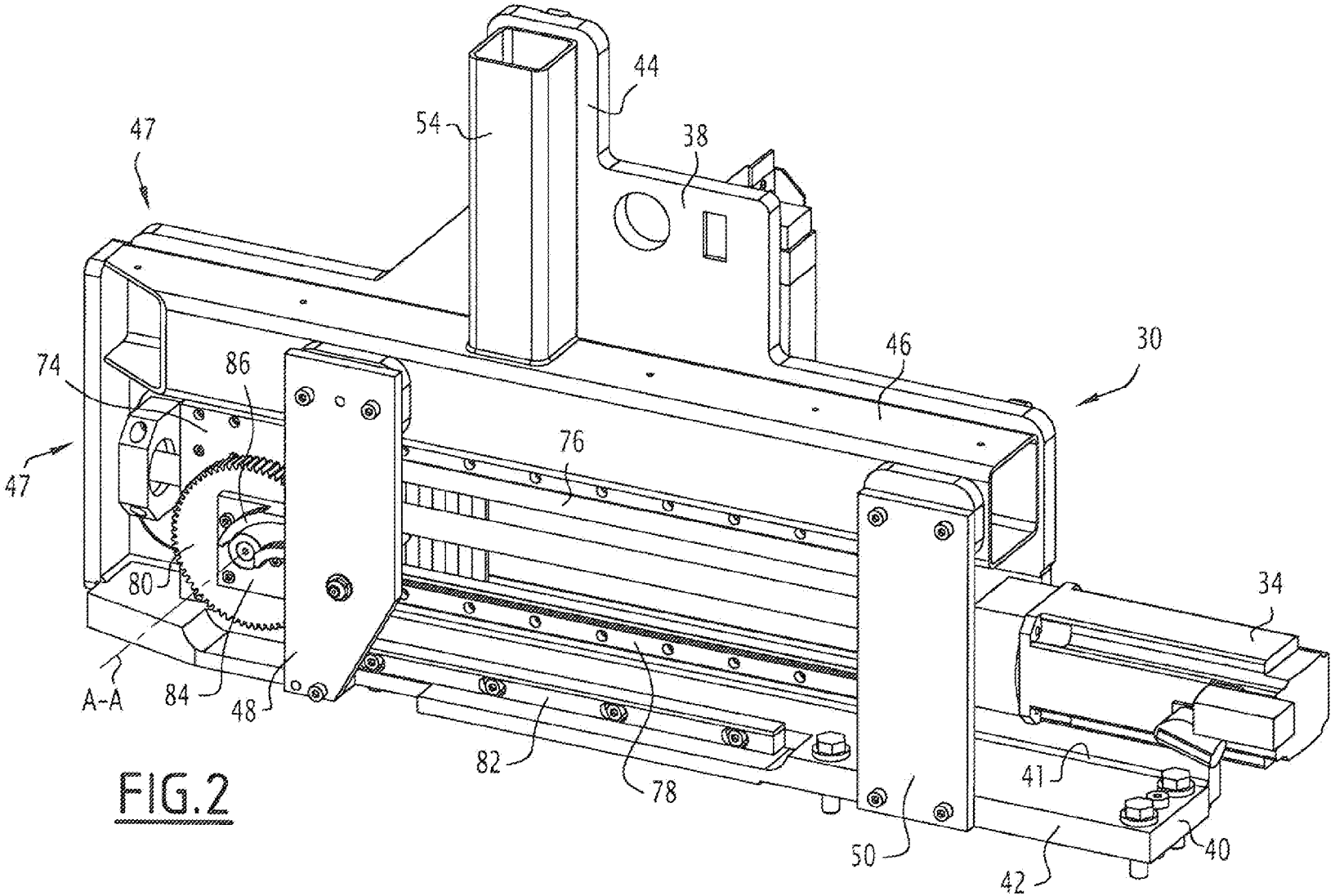
FIG. 2 is a perspective rear view of a portion of a transfer device according to the invention.

The motor 34 is able to drive a carriage 74, which is illustrated in FIGS. 1, 2 and 4, in translation in the direction Y.

The drive means 36 comprise two guide rails 76, 78 of the carriage 74 extending in the direction Y, a toothed wheel 80 and a rack 82, with which the toothed wheel 80 is engaged.

The guide rails 76 and 78, which are illustrated in FIG. 2, are fixed in alignment with each other, one to the beam 46 and the other to the plate 40.

The toothed wheel 80 has an axis of rotation A-A.

The rack 82 is fixed to the plate 40 parallel with the rails 76 and 78.

The drive means 36 further comprise a plate 84 which supports a channel 86, and a roller 88 which has a shape adapted to cooperate with the channel 86.

The plate 84 is fixedly joined to the rear face of the toothed wheel 80.

The channel 86 comprises a first guide portion 90 which is eccentric relative to the axis of rotation A-A of the wheel 80 and a second guide portion 92 which is near the axis of rotation of the wheel 80.

The first guide portion 90 has a profile which is obtained by means of engineering drawing so that the holding arm 32 has an arced trajectory which is tangential to the normal N2 relative to the plane of the bottom 14 of the cap. The second portion 92 has a profile corresponding to a cycloidal movement.

The second channel portion 92 has a length of from ⅓ to ½ of the total length of the channel 86.

The roller 88, which is illustrated in FIGS. 5 to 9, is fixed to the front face of the cross-member 48 facing the rear face of the toothed wheel 80.

The rack 82 extends over a length equal to the perimeter of the toothed wheel 80, from which the length of the second portion 92 of the channel is subtracted.

The drive means 36 further comprise a shaft 94, one end of which is fixed to the centre of the toothed wheel 80 parallel with the axis of rotation A-A, and a rotating support 96 which is fixedly joined to the other end of the shaft 94.

The shaft 94 is able to be driven in terms of rotation by the carriage 74 when the carriage 74 is moved along the guide rails 76 and 78. To that end, the carriage 74 comprises a bearing 97, through which the shaft 94 extends.

The rotating support 96 extends in a plane parallel with the plane of the toothed wheel 80. It is capable of pivoting about the axis of rotation A-A of the toothed wheel 80.

The drive means 36 finally comprise a connecting rod 98, one end 100 of which is connected to a front face 104 of the rotating support 96, a slide 104 which is connected to the other end 106 of the connecting rod and a slide rail 110 for guiding the slide 104.

The slide rail 110 is fixed to the front face 45 of the support plate 38. It extends over the extension 44 in the direction Z.

The slide rail 110 extends over a length substantially equal to the diameter of the toothed wheel 80, plus the length of the connecting rod 98.

The end 100 of the connecting rod is fixed to the rotating support 96 at a distance from the axis of rotation A-A equal to the primitive radius of the toothed wheel 80.

The connecting rod 98 is fixed, over a portion of its length, to a side of the cross-member 72 of the holding arm 32 in order to drive it in terms of movement.

The connecting rod 98 has a length equal to the perimeter of the toothed wheel 80, plus the length of the first channel portion 90, divided by $\sqrt{2}$.

Figure 3:
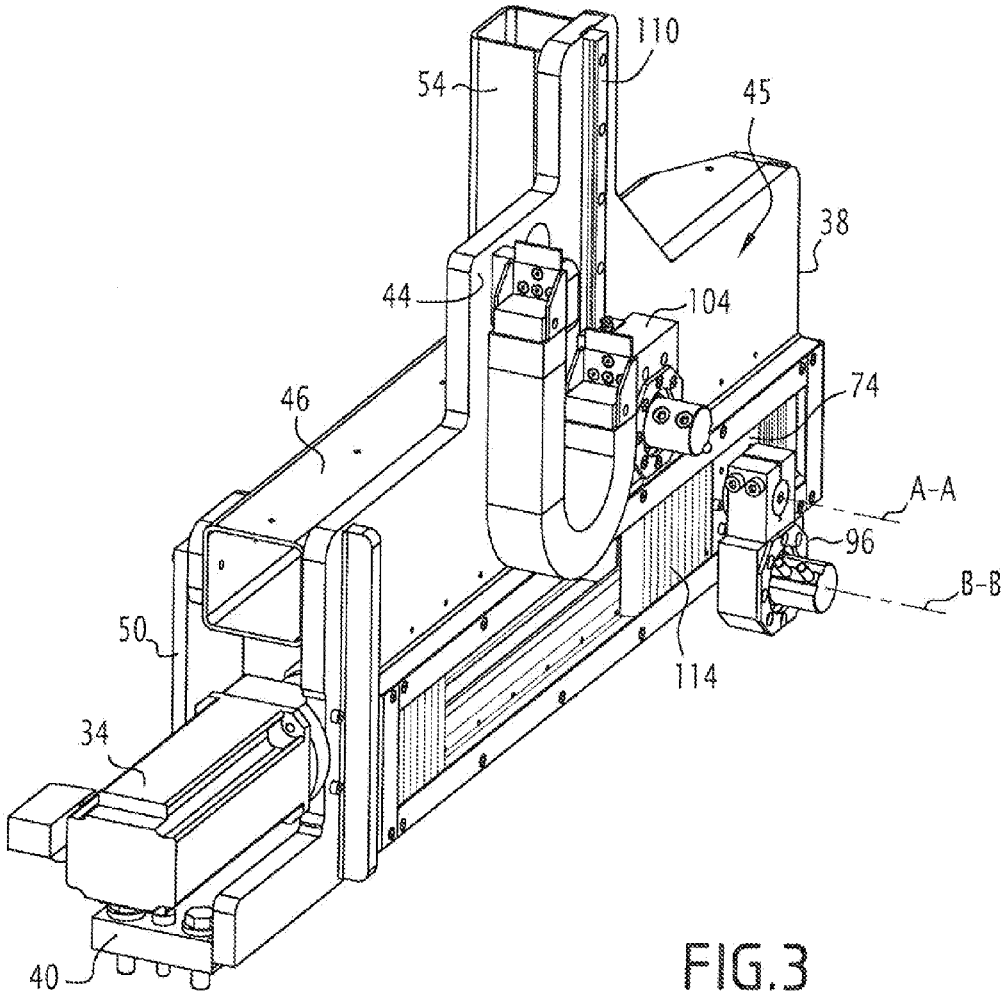
FIG. 3 is a perspective front view of the transfer device of FIG. 2.

An assembly of power supply and control cables generally having a J-like shape (FIG. 3) is fixed to the front face 45 of the support plate 38.

Curtains 114 for protection against dust are mounted in longitudinal rails at the front face 45 of the frame.

The printing press 2 further comprises a control unit 115 which is able to control the means 5 for driving the rotating plate and the motor 34 for driving the holding arm 32.

The control unit 115 is able to control in terms of time the movement of the rotating plate 4 and the actuation of the motor 34 so that the movement of the holding arm 32 is synchronised with the rotation movement of the rotating plate 4.

To that end, the control unit 115 is able to control the motor 34 and the drive means 5 so that the holding arm 32 arrives at the end of travel for depositing the object on the retention and drive device 6 when the retention and drive device 6 is located in alignment with the support zone 28.

The control unit is also able to control the actuation device 68 of the holding clips 62, 64 in order to control the opening and closing of each pair of clips 62, 64 each time the holding arm 32 is at the end of travel in order to grip the object arranged on the support zone and to release the object in the retention and drive device 6.

During operation, during an initial step, the rotating plate 4 is able to pivot about its axis of rotation in order to arrange the retention and drive device 6 which is carried thereby opposite the charging conveyor 24. The transport belt 28 moves in order to bring the bottle 8 to the end of the charging conveyor 24.

Figure 6:
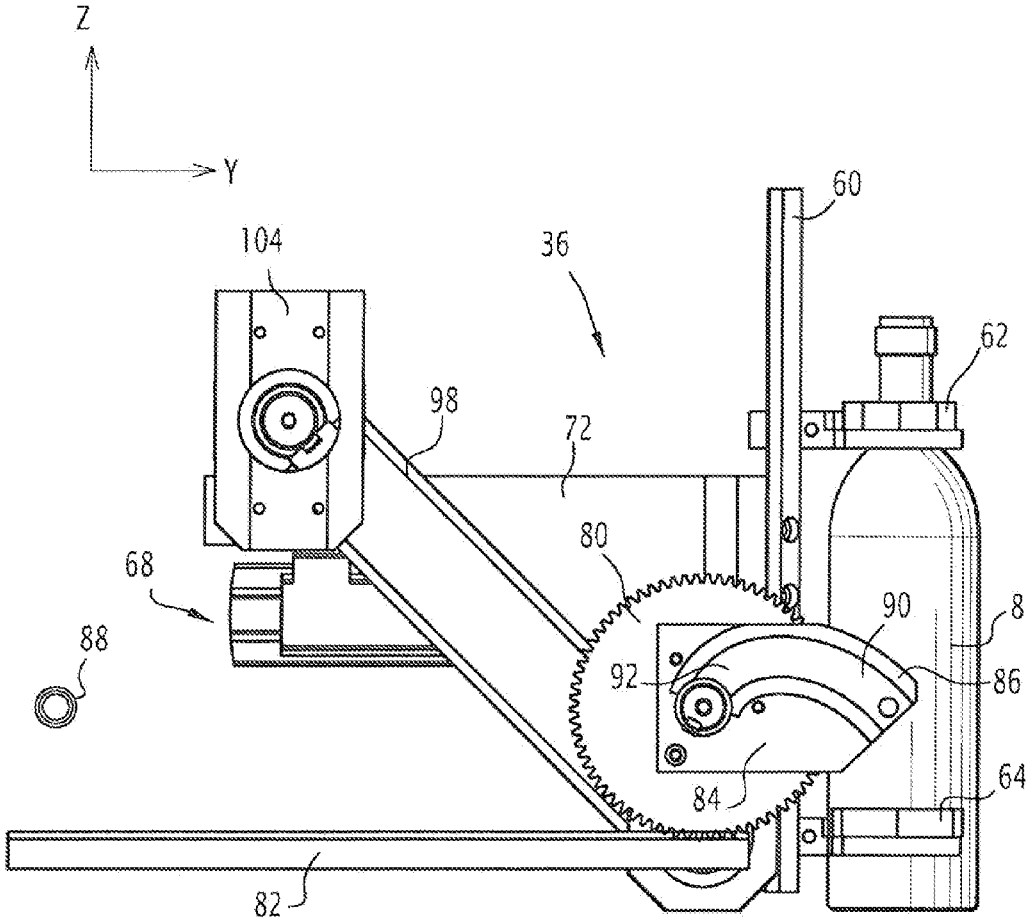
FIG. 6 is a rear view of a portion of the drive means and the holding arm in a position when the object is being taken.

The means for driving the transfer device, as arranged during the initial step, are illustrated in FIG. 6. The carriage 74, the toothed wheel 80 and the first end 100 of the connecting rod are arranged at an end of the frame 30 that is adjacent to the cross-member 50 and the motor 34. The other end 106 of the connecting rod is in a lower position near the plate 40. The support bars 58, 60 of the holding clips 62, 64 are arranged in a vertical state near the bottle 8. The actuation device 68 is actuated so that the pairs of clips 62, 64 grip the bottle 8.

Figure 7:
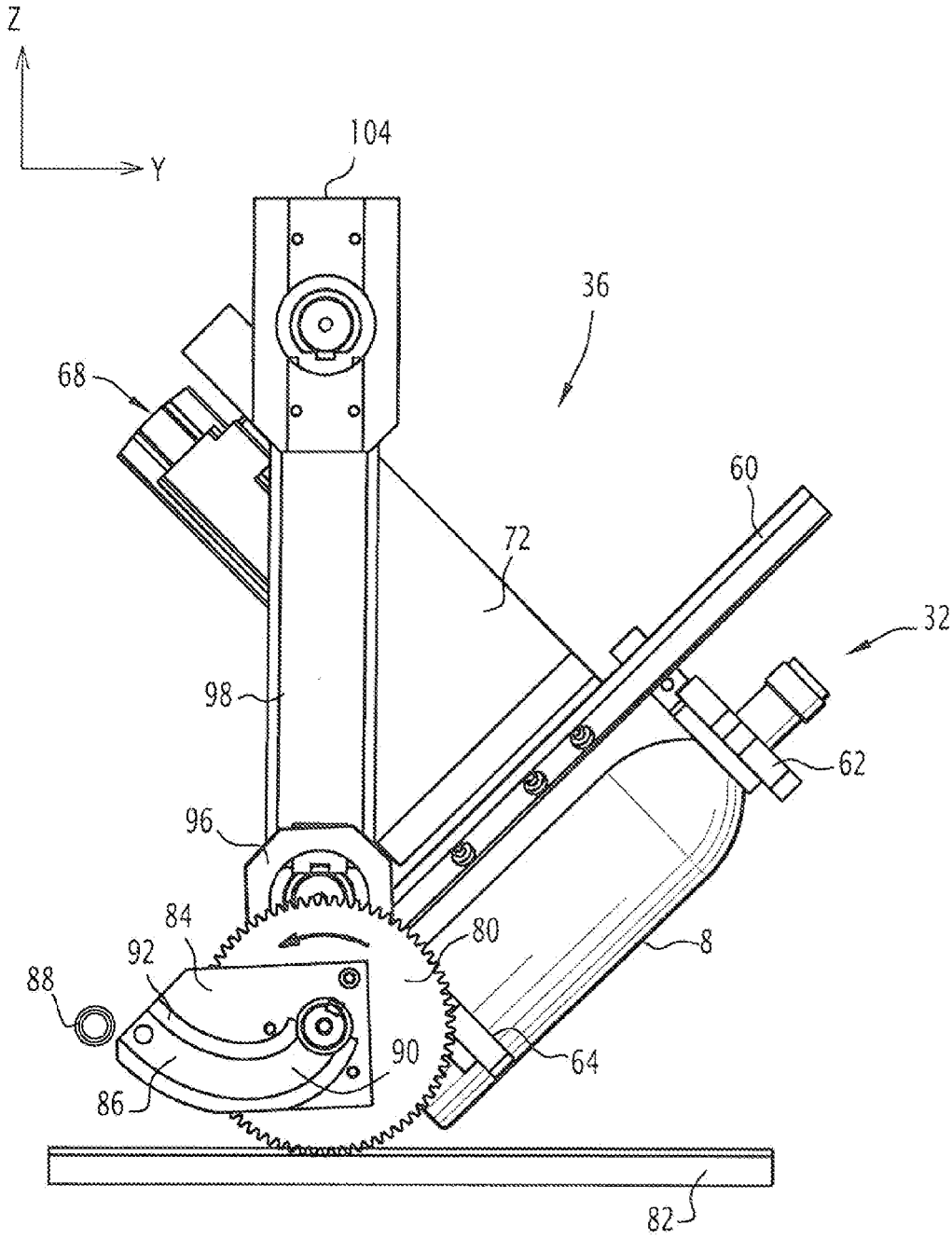
FIG. 7 is a view similar to the view of FIG. 6 during the transfer of the object.

During a transfer step, illustrated in FIG. 7, the drive carriage 74 is moved towards the other end of the frame 30 in the direction towards the cross-member 48. The toothed wheel 80 is rotated in the counter-clockwise direction on the rack 82 so that the end 100 of the connecting rod is rotated about the axis A-A. Urged by the movement of the rotating support 96 transmitted by the connecting rod 98, the slide 104 moves on the slide rail 110 in the direction Z.

The end 100 of the connecting rod is driven in accordance with a cycloidal movement. The end 106 of the connecting rod is driven in terms of movement in accordance with a vertical translation movement. The holding arm 32 is driven in terms of movement in accordance with a complex movement resulting from the combination of the movements of the ends 100 and 106 of the connecting rod which are carried out simultaneously. In particular, the bottle 8 is first lifted in order to become disengaged from the conveyor 24, then the bottle is pivoted in order to bring its axis of revolution in accordance with the horizontal direction Y.

Figure 10:
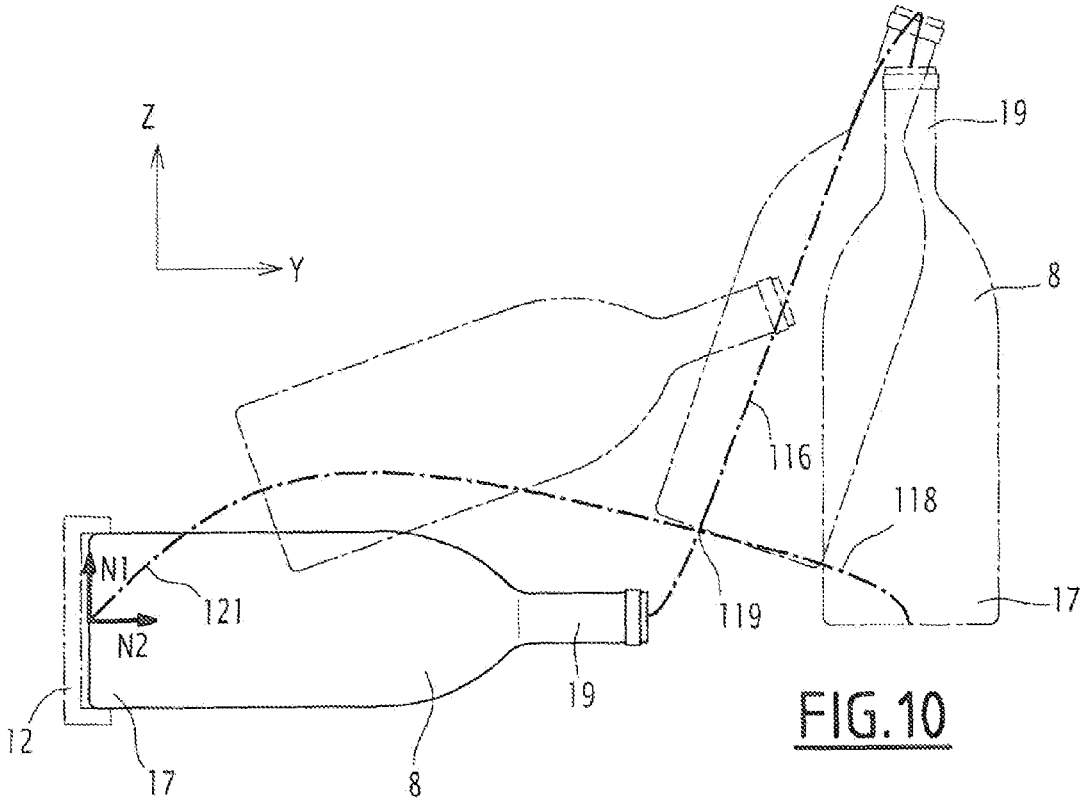
FIG. 10 is a front view of the object to be printed, illustrated in three transfer positions of the object and in a position at the end of approach travel towards the cap.

As is visible in FIG. 10, the neck 19 is raised in order to move the bottle 8 away from the support zone 28 at the start of the trajectory 116 of the neck 19. At the same time, the base 17 of the bottle pivots from the very beginning of the trajectory 118 of the base 17.

The trajectory 116 of the neck 19 of the bottle and the trajectory 118 of its base 17 intersect as is visible in FIGS. 1 and 10. In particular, the base 17 passes through the intersection point 119 before the neck 19.

Figure 8:
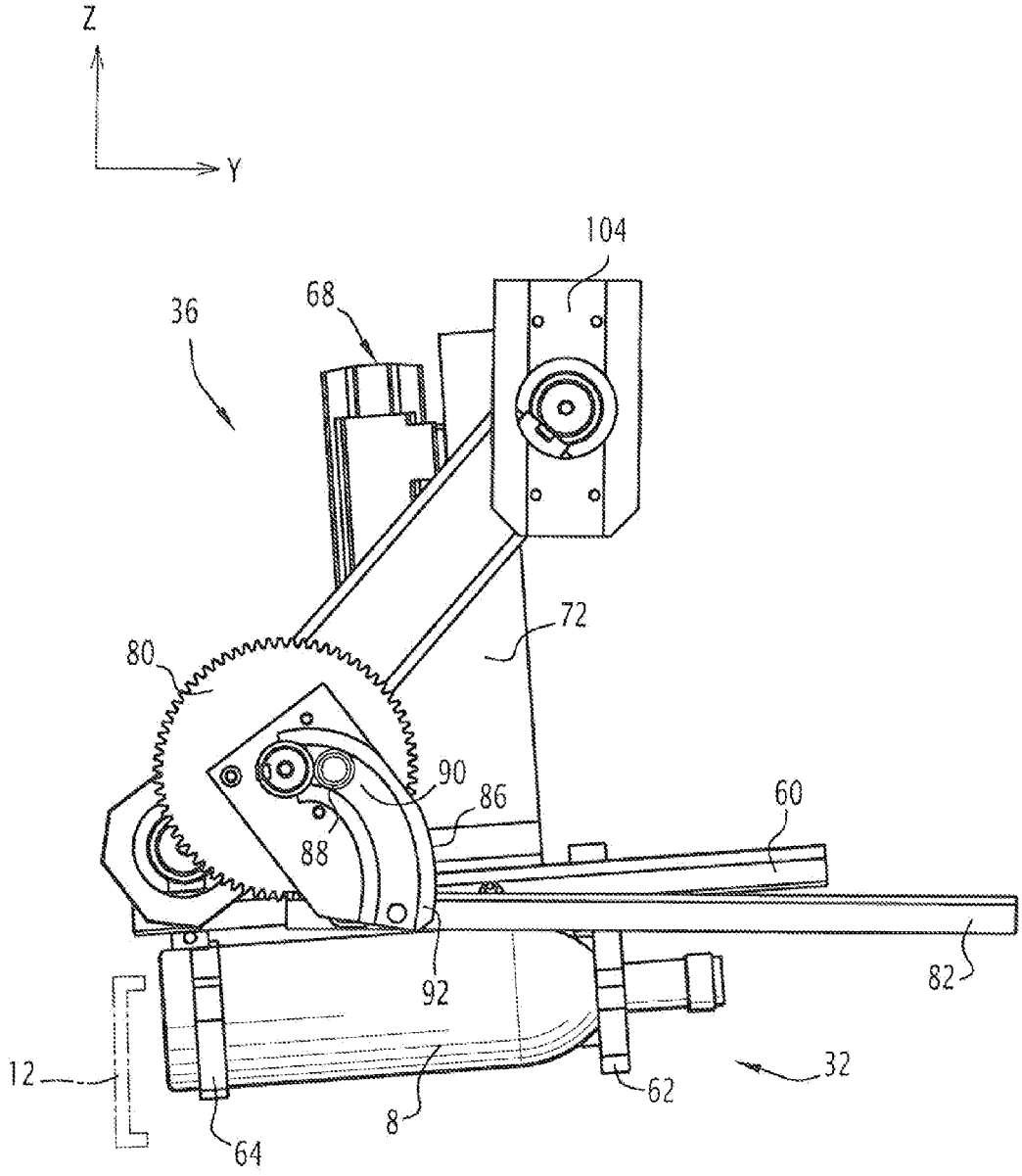
FIG. 8 is a view similar to the view of FIG. 6 during the approach towards the cap.

During a step for approaching the cap, illustrated in FIG. 8, the roller 88 is introduced into the second portion 92 of the channel 86 in the region of the axis of rotation A-A and is guided by the channel 86. The slide 104 moves on the slide rail 110 in the opposite direction to direction Z. The end 100 is moved in accordance with a movement imposed by the second portion 92 of the channel, which has a profile corresponding to the cycloidal movement imposed during the transfer step by the toothed wheel 80 and the rack 82.

Figure 9:
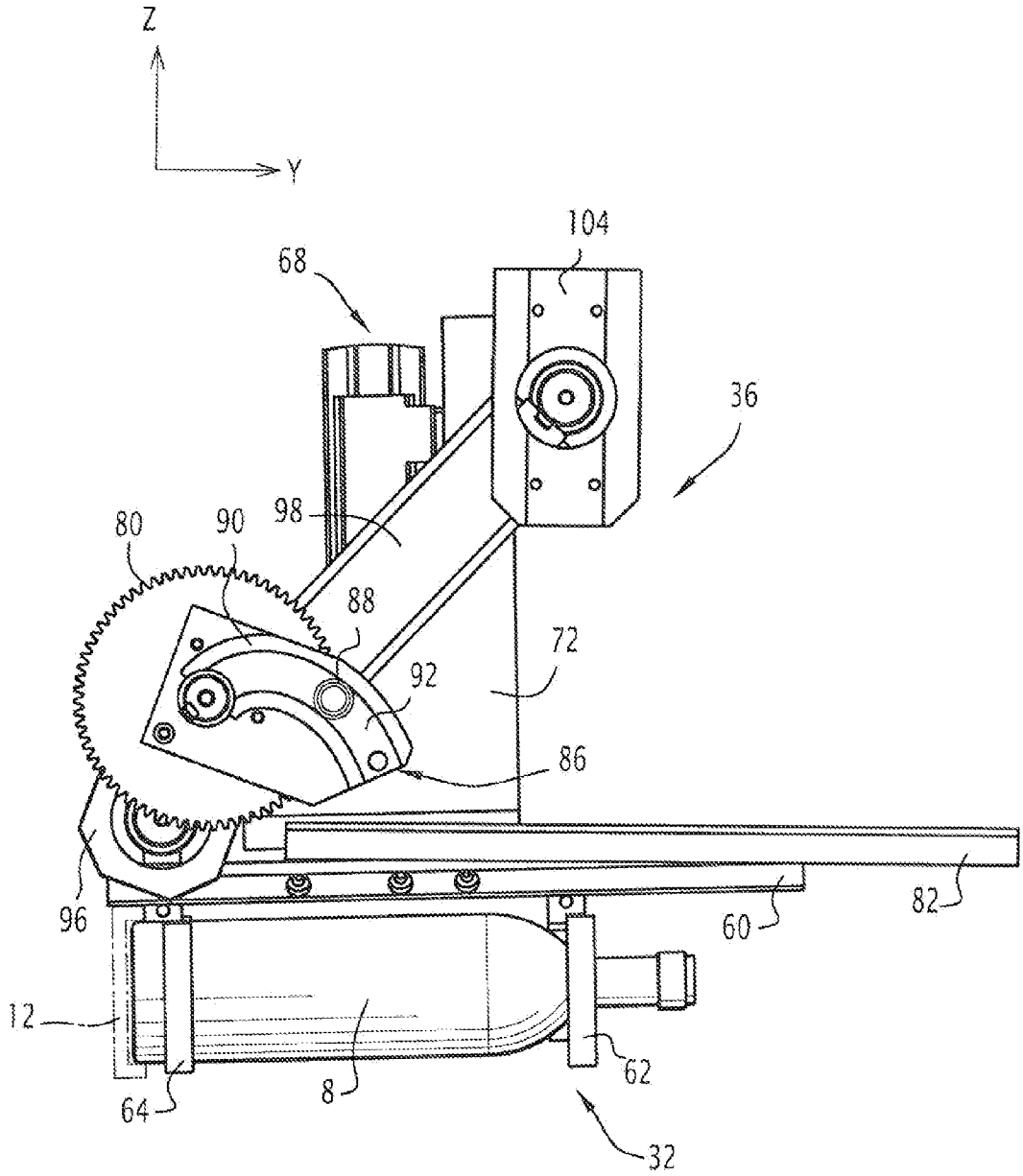
FIG. 9 is a view similar to the view of FIG. 6 at the end of approach travel towards the cap.
Figure 11:
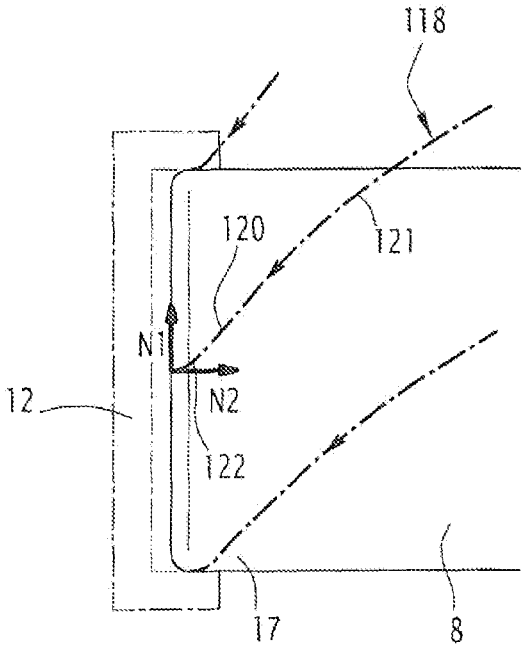
FIG. 11 is a front view drawn to an enlarged scale partially illustrating the object to be printed in a position at the end of approach travel towards the cap.

During a step at the end of the approach towards the cap, illustrated in FIGS. 9, 10 and 11, the end 100 of the connecting rod is moved in accordance with a movement imposed by the first portion 90 of the channel. The toothed wheel 80 is no longer carried by the rack 82. The slide 104 moves on the slide rail 110 in a direction opposite the direction Z. The movement of the end 100 of the connecting rod is thereby deviated in order to impose on the holding arm 32 trajectories 116, 118 which allow the base 17 of the bottle to be introduced into the cap.

Specifically, the trajectory of the base 17 of the object has a curved portion having an inflection point 120 in its portion 121 approaching the cap 12, and at the same time comprises a component in accordance with the normal N1 relative to the support zone 28 and a component in accordance with the normal N2 relative to the bottom 14 of the cap. At the end of travel of the portion 121 approaching the cap 12, the trajectory 118 of the base 17 has an arced portion 122 which is tangential to the normal N2 in order to introduce the base 17 into the cap.

It should be noted that the rotating plate of the printing press can be positioned at the same height as the transport belt of the conveyor or at any other selected height, irrespective of the length of the object to be printed. This is advantageous over the known arrangement, set out above, in which the transfer device comprises a pivoting lifting arm whose length is a function of the length of the object to be printed. In such an arrangement, the rotating plate which carries retention and drive devices for the objects is positioned at a substantial height, which necessitates a chassis having a substantial weight and makes it difficult to carry out maintenance operations on the printing stations arranged above the rotating plate.

The invention claimed is:

1. Transfer device which is intended to move an object between a support zone and a cap, the object comprising a base and an opening, the cap comprising a bottom which extends in a plane perpendicular to the support zone and a peripheral rim having a shape complementary to the shape of the base of the object, the device comprising:

a frame;

at least one holding arm which is carried by the frame, the holding arm being able to carry the object to be moved; and drive means which are carried by the frame;

wherein the drive means are able to move the holding arm so that the opening of the object is moved firstly along an initial trajectory portion which comprises a component, in a direction perpendicular to the support zone, which is orientated in the opposite direction to the support zone, then along a curve which extends through a point of the trajectory of the base of the object, after the base of the object has passed through that point.

2. Transfer device according to claim 1, wherein the drive means are able to move the base of the object at the end of travel towards the cap, in accordance with at least one arced trajectory portion which is tangential to a normal relative to the bottom of the cap, in order to introduce the base of the object into the cap.

3. Transfer device according to claim 1, wherein the trajectory of the base of the object has a curved portion having an inflection point in its portion for approaching the cap.

4. Transfer device according to claim 1, wherein the drive means are able to lift up the object, then to make it rotate around an axis of rotation having a first direction, from a position in which the axis of revolution of the object is arranged according to a second direction normal to the support zone to a position in which the axis of revolution of the object is arranged according to a third direction normal to the bottom of the cap, the first direction being perpendicular to the second and to the third directions, the bottom of the cap being parallel to the plane defined by the first and the second directions.

5. Transfer device according to claim 1, wherein the drive means comprise a connecting rod which is fixedly joined to the holding arm, the connecting rod comprising a first end and a second end, the first end being guided in a movement direction which extends substantially in accordance with the normal relative to the support zone, the second end being moved in accordance with a cycloidal movement in order to raise then pivot the object, during the transfer of the object from the support zone towards the cap.

6. Transfer device according to claim 5, wherein the drive means comprise:

a toothed wheel, the first end of the connecting rod being connected to the toothed wheel at a point thereof located at a distance from the axis of rotation of the toothed wheel that is equal to the primitive radius thereof;

a rack which is fixed to the frame; and propulsion means which are able to drive the toothed wheel along the rack.

7. Transfer device according to claim 6 wherein the drive means comprise:

a first guide means which is connected to the first end of the connecting rode;

propulsion means which are able to drive the first guide means in rotation; and a second guide means which is fixedly joined to the frame and which is able to cooperate with the first guide means, the first guide means being shaped in order to impose on the holding arm a trajectory corresponding to the approach travel towards the cap and allowing the object to be introduced into the cap at the end of approach travel towards the cap.

8. Transfer device according to claim 7, wherein the first guide means comprises a channel having a first channel portion which is shaped in order to impose on the first end of the connecting rod the movement for introducing the object into the cap and a second channel portion which is shaped in order to impose the cycloidal movement on the first end of the connecting rod.

9. Transfer device according to claim 7 wherein the first guide means is fixedly joined to the toothed wheel so that the same propulsion means are able to drive the toothed wheel in terms of rotation and the first guide means during the transfer of the object and at the end of approach travel towards the cap.

10. Transfer device according to claim 5, wherein the drive means comprise:

a first guide means which is connected to the first end of the connecting rod;

propulsion means which are able to drive the first guide means in rotation; and a second guide means which is fixedly joined to the frame and which is able to cooperate with the first guide means, the first guide means being shaped in order to impose on the holding arm a trajectory corresponding to the approach travel towards the cap and allowing the object to be introduced into the cap at the end of approach travel towards the cap.

11. Transfer device according to claim 10, wherein the first guide means comprises a channel having a first channel portion which is shaped in order to impose on the first end of the connecting rod the movement for introducing the object into the cap and a second channel portion which is shaped in order to impose the cycloidal movement on the first end of the connecting rod.

12. Transfer device according to claim 11, wherein the connecting rod extends over a length equal to the length of the perimeter of the toothed wheel multiplied by $\sqrt{2}$ and added to the length of the second portion of the channel.

13. Printing press comprising:

a chassis;

a plate which rotates about a vertical axis of rotation and which is carried by the chassis;

at least one device for retaining and driving the object to be printed that is carried by the rotating plate, the retention and drive device comprising a cap; and at least one printing station which is carried by the chassis in alignment with the rotating plate;

wherein it further comprises a transfer device according to claim 1, which is able to take the object to be printed from a support zone and to position it inside the cap of the device for retaining and driving the object.

14. Printing press according to claim 13, wherein the drive means of the transfer device comprise a connecting rod which is fixedly joined to the holding arm, the connecting rod comprising a first end and a second end, the first end being guided in a movement direction which extends substantially in accordance with the normal relative to the support zone, the second end being moved in accordance with a cycloidal movement in order to raise then pivot the object, during the transfer of the object from the support zone towards the cap, wherein the drive means comprise:

a toothed wheel, the first end of the connecting rod being connected to the toothed wheel at a point thereof located at a distance from the axis of rotation of the toothed wheel that is equal to the primitive radius thereof;

a rack which is fixed to the frame; and propulsion means which are able to drive the toothed wheel along the rack, and wherein the printing press comprises means for driving the rotating plate in rotation and a control unit, the control unit being able to control the means for driving the rotating plate and the propulsion means in such a manner that the holding arm is in a travel end position when the or each retention and drive device is located in alignment with the support zone in order to arrange the object in the retention and drive device.

15. Printing press according to claim 14, wherein the holding arm comprises at least one pair of holding clips which is able to grip and release the object, and a device for actuating the or each pair of clips, and the control unit is able to further control the actuation device in order to actuate the or each pair of holding clips when the holding arm is in a travel end position.

* * * * *